US005593050A

United States Patent [19]

Lange

[11] Patent Number: 5,593,050

[45] Date of Patent: Jan. 14, 1997

[54] BRIDGE CRANE

[75] Inventor: Walter Lange, Ludesch, Austria

[73] Assignee: Liebherr-Werk Nenzing Ges.M.B.H., Nenzing, Austria

[21] Appl. No.: 360,809

[22] PCT Filed: Nov. 11, 1993

[86] PCT No.: PCT/EP93/03153

§ 371 Date: Dec. 28, 1994

§ 102(e) Date: Dec. 28, 1994

[87] PCT Pub. No.: WO94/11292

PCT Pub. Date: May 26, 1994

[30] Foreign Application Priority Data

Nov. 11, 1992 [DE] Germany ..... 42 38 096.0
Feb. 2, 1993 [DE] Germany ..... 43 02 894.2

[51] Int. Cl.[6] ..... B66C 5/04

[52] U.S. Cl. ..... 212/325; 212/294

[58] Field of Search ..... 212/307, 312, 212/325, 294

[56] References Cited

U.S. PATENT DOCUMENTS 1,428,809 9/1922 Zimmerman ..... 212/307
3,258,129 6/1966 Munck ..... 212/325
5,140,925 8/1992 Tyring ..... 212/325

FOREIGN PATENT DOCUMENTS 109315 8/1966 Norway ..... 212/325
596544 1/1948 United Kingdom ..... 212/307

*Primary Examiner*—Thomas J. Brahan
*Attorney, Agent, or Firm*—Morgan & Finnegan, LLP

[57] ABSTRACT

The invention relates to a bridge crane and more particularly ship's bridge crane, comprising a bridge, which has two transverse bearers extending parallel to one another and constituting a track for the travelling crane and folding lateral parts, respectively pivoted at the ends of the bearers, for the selective extension of the track. In accordance with the invention the lateral parts are able to be folded from a position, in which they are in alignment with the transverse bearers, through 90° into their inactive position, in which tips thereof are directed towards the respectively other transverse bearer.

16 Claims, 1 Drawing Sheet

BRIDGE CRANE

FIELD OF THE INVENTION

The invention relates to a bridge crane and more particularly ship's bridge crane, comprising a bridge, which has two transverse bearers extending parallel to one another and constituting a track for the travelling crane and folding lateral parts, respectively pivoted at the ends of the bearers, for the selective extension of the track.

BACKGROUND OF THE INVENTION

Bridge cranes are for instance erected on ocean going ships. The crane is as a rule employed for loading and unloading containers, bulk goods and timber. For more rapid unloading of ships it is frequent practice to employ at least two such bridge cranes.

A number of forms of such cranes have been proposed. Lateral parts are pivoted on two transverse bearers for selective extension of the track so that they are able to be swung out from the position in line with the transverse bearers through 180° into an inactive position in which they are folded back against the transverse bearers on the outside and extend in parallelism to the transverse bearers. This however leads to the disadvantage that no goods may be loaded in the way of the swinging lateral parts and adjacent to the bridge crane. This is especially a disadvantage in the case of container freighters. For the optimum use of the cargo space a plurality of layers of containers must be loaded, it normally is desirable for the pivotal path of the lateral parts to be used as well. This means in practice that aboard container ships conventional bridge cranes are only able to be utilized, after the layers of containers placed adjacent to the bridge cranes have been removed with external load cranes.

SUMMARY OF THE INVENTION

One object of the present invention is to provide such an improved form of a bridge crane of the sort noted initially that only requires a minimum amount of space for operation thereof.

Taking as a starting point a bridge crane of this type this object is to be achieved since the lateral parts are able to be folded from a position in which they are in line with the transverse bearers through 90° into their inactive position wherein the tips thereof are pointed towards the respectively other transverse bearer.

In accordance with this design the lateral parts are no longer swung outwards about the transverse bearer and consequently around the bridge crane and instead are merely folded inwards through 90°. Accordingly it is then possible for the bridge crane to be brought into the operating position even if bulky freight, as for instance containers, is stacked directly adjacent to it. Furthermore the pivotal displacement to be made by the lateral parts is shortened. This leads to a shorter get-ready time for the bridge crane moved out of its inactive position.

In keeping with yet another possible form of the invention the transverse bearers can be at different heights in relation to one another so that the lateral parts are superposed in their inactive position. In this case the lateral wall parts respectively carrying the running gear are so adapted to the height of the transverse bearers so that the travelling crane is arranged substantially horizontally.

In accordance with further developments of the invention the lateral parts may be respectively folded parallel to the legs downwards, outwards perpendicularly to the transverse bearers and upwards into positions extending the legs. The lateral parts may furthermore be folded through 180° upwards so that they lie on top of the transverse bearers.

A secondary travelling crane unit may be arranged on the travelling crane and may bear an unloading device.

The lateral parts may be folded hydraulically or electrically, that is to say using a suitable electric motor, out of their inactive position into the position in which they are in line with the transverse bearers. The lateral parts may furthermore be designed to telescope.

Further advantageous developments and convenient forms of the invention will be understood from the following detailed descriptive disclosure of one embodiment thereof with reference to the accompanying drawings.

DETAILED DESCRIPTION OF THE FIGURES

Figure 1:
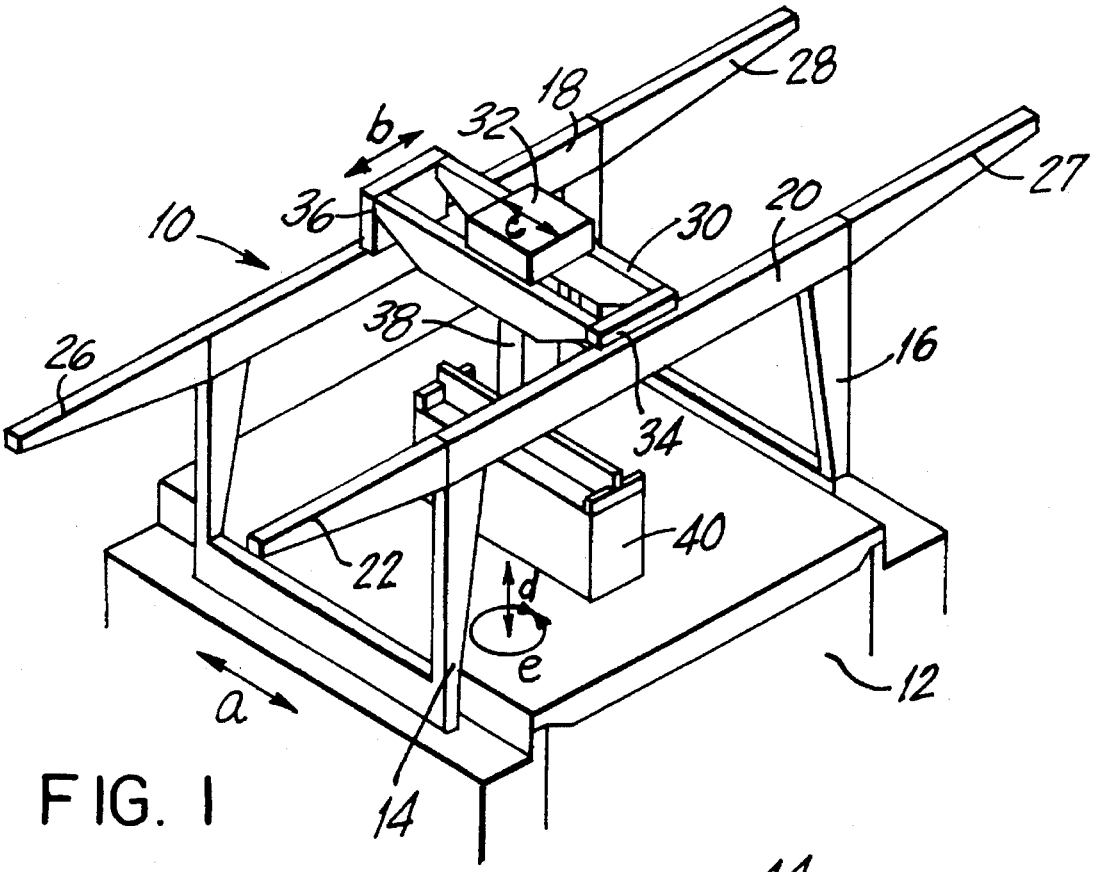
FIG. 1 is a perspective elevation of one embodiment of the bridge crane in accordance with the invention in the operational position.

The bridge crane 10 illustrated in FIG. 1 is arranged to be moved along the hold 12 of a ship in the direction a. The bridge crane 10 comprises the portals 14 and 16, in the case of which the travelling bearers and the legs form a structure which as seen from the side has the shape of an inverted letter U. The respective upper ends of the legs of such portals are joined together by transverse bearers 18 and 20. The transverse bearers 18 and 20 simultaneously constitute the track for a travelling crane 30.

In order to extend the track, lateral parts 22 and 24 are respectively pivoted on the ends of the transverse bearer 20 and the lateral parts 26 and 28 and are pivoted respectively at the ends of the transverse bearer 18. In operational position depicted in FIG. 1, the lateral parts 22, 24 and, respectively, 26 and 28 are aligned with the transverse bearers 20 and 18 so that a correspondingly extended or lengthened track for the travelling crane is formed. The travelling crane may therefore be moved in the direction of the double arrow b along the track so formed, whereas the portals may be moved along the direction denoted by the double arrow a.

Figure 2:
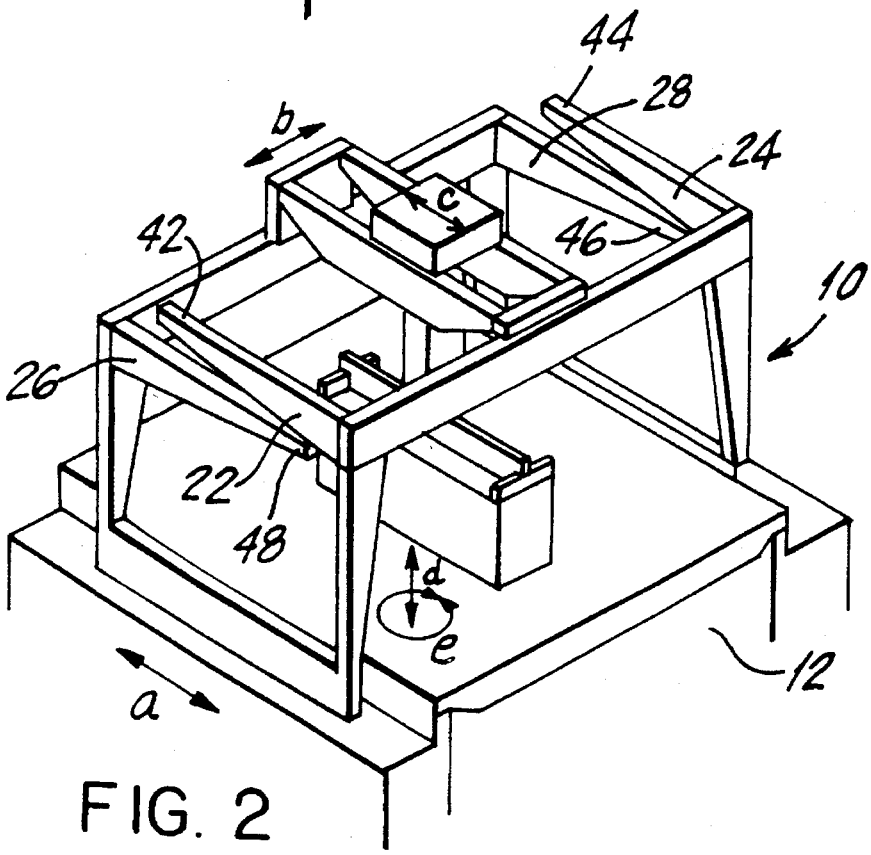
FIG. 2 shows the bridge crane in accordance with FIG. 1 in the inactive position.

In the embodiment of the invention illustrated here the legs of the portals 14 and 16 for the transverse bearers 18 and 20 are of different length so that the parallel transverse bearers are arranged at different heights. This is something which will be particularly clear from FIG. 2. Owing to the arrangement at different levels of the transverse bearers 18 and 20 it is possible to fold the lateral parts 22, 24 and, respectively, 26 and 28 through 90° without any difficulties into their inactive position, the respective tips 42 and, respectively, 46, 48 of the lateral parts pointing towards the opposite transverse bearer 18 and, respectively, 20. As shown in FIG. 2 it is possible, owing to the different levels of the transverse bearers, for the lateral part 22 to be arranged in the inactive position somewhat above the lateral part 26, while the lateral part 24 is arranged above lateral part 28.

In order to ensure horizontal alignment of the travelling crane 30, the lateral wall parts 34 and, respectively, 36 of the travelling crane, which each carry the running gear of the travelling crane, are made of different height. As shown in FIGS. 1 and 2, owing to the different heights of the structure the different heights of the transverse bearer 18 and 20 are compensated for.

A secondary travelling crane unit 32 is mounted on the travelling crane 30 for movement in either direction as indicated by the double arrow c. The travelling crane unit 32 carries an unloading arrangement 38, which in the illustrated embodiment of the invention serves to receive containers 40. The containers 40 are able to be moved and furthermore swung in the directions of the double arrow d and, respectively, the double arrow e.

The lateral parts 22, 24 and 28 may be designed to telescope in a manner not illustrated here.

An alternative design, which is not depicted in detail in the figures, may comprise two transverse bearers at the same level. In this case the transverse bearer 18 is for instance made shorter than the transverse bearer 20. To take this into account the lateral parts 26 and, respectively, 28 are made somewhat longer than the lateral parts 22 and, respectively, 24. In the inactive position the lateral parts are not superposed as in the embodiments of the invention as illustrated in FIG. 1; in this case the lateral parts are arranged alongside each other in the inactive position.

I claim:

1. A ship's bridge crane, comprising a bridge, said bridge having two transverse bearers extending parallel to one another and constituting a track for a travelling crane and said traverse bearers having folding lateral parts, respectively pivoted at the ends of the bearers, for the selective extension of the track, wherein the lateral parts are able to be pivoted from a position, in which they are in line with the transverse bearers through 90° into a folded inactive position, the transverse bearers are arranged at different levels so that the lateral parts are arranged over each other in their folded, inactive position, and wherein the travelling crane has wall parts carrying a running gear, said running gear being so adapted in height to a height of the transverse bearers that the travelling crane is arranged substantially horizontally.

2. The bridge crane according to claim 1, wherein the lateral parts are able to be pivoted from a position, in which they are in line with the traverse bearers through 90° into a folded inactive position in which tips thereof are pointed towards the respectively other transverse bearer.

3. A ship's bridge crane according to claim 1 wherein the lateral parts are able to be folded from a position, in which they are in line with the transverse bearers through 90° into their folded inactive position, in which they extend in parallelism to legs of portals of the bridge crane.

4. The bridge crane as claimed in claim 3, further comprising a travelling crane unit arranged on the travelling crane, said travelling crane unit bearing an unloading arrangement.

5. The bridge crane as claimed in claim 3, wherein the lateral parts are able to be folded from their folded inactive position into a position, in which they are in alignment with the transverse bearers.

6. A ship's bridge crane according to claim 1, wherein the lateral parts are able to be folded from a position, in which they are in line with the transverse bearers through 90° into their folded inactive position, in which they respectively (so) are arranged perpendicularly to the transverse bearers that tips thereof are directed away from the transverse bearers.

7. The bridge crane as claimed in claim 6, further comprising a travelling crane unit arranged on the travelling crane, said travelling crane unit bearing an unloading arrangement.

8. The bridge crane as claimed in claim 6, wherein the lateral parts are able to be folded from their folded inactive position into a position, in which they are in alignment with the transverse bearers.

9. A ship's bridge crane according to claim 1, wherein the lateral parts are able to be folded from a position, in which they are in line with the transverse bearers through 90° into their folded inactive position, in which the lateral parts constitute an extension of legs of portals of the bridge crane.

10. The bridge crane as claimed in claim 9, further comprising a travelling crane unit arranged on the travelling crane, said travelling crane unit bearing an unloading arrangement.

11. The bridge crane as claims in claim 9, wherein the lateral parts are able to be folded from their folded inactive position into a position, in which they are in alignment with the transverse bearers.

12. A ship's bridge crane according to claim 1, wherein the lateral parts are able to be folded from a position, in which they are in line with the transverse bearers through 180° into their folded inactive position, in which they rest on top of the transverse bearers and extend parallel to the same.

13. The bridge crane as claimed in claim 12, further comprising a travelling crane unit arranged on the travelling crane, said travelling crane unit bearing an unloading arrangement.

14. The bridge crane as claimed in claim 12, wherein the lateral parts are able to be folded from their folded inactive position into the position, in which they are in alignment with the transverse bearers.

15. The bridge crane as claimed in claim 1, further comprising a travelling crane unit arranged on the travelling crane, said travelling crane unit bearing an unloading arrangement.

16. The bridge crane as claimed in claim 1 characterized in that the lateral parts are able to be folded from their folded inactive position into a position in which they are in alignment with the transverse bearers.

* * * * *